US007340852B1

(12) United States Patent
Tai

(10) Patent No.: US 7,340,852 B1
(45) Date of Patent: Mar. 11, 2008

(54) SHOE

(76) Inventor: Jen-Lung David Tai, 19507 N. 65th Ave., Glendale, AZ (US) 85308

( * ) Notice: Subject to any disclaimer, the term of this patent is extended or adjusted under 35 U.S.C. 154(b) by 532 days.

(21) Appl. No.: 10/916,656

(22) Filed: Aug. 12, 2004

(51) Int. Cl.
*A43B 3/24* (2006.01)
*A43B 3/12* (2006.01)

(52) U.S. Cl. ..... 36/100; 36/11.5; 36/101; 36/94

(58) Field of Classification Search ..... 36/100, 36/101, 88, 93, 110, 77 R
See application file for complete search history.

(56) References Cited

U.S. PATENT DOCUMENTS 2,507,120 A * 5/1950 Shapiro ..... 36/11.5
3,225,462 A 12/1965 Lamberti
4,489,509 A * 12/1984 Libit ..... 36/7.1 R
5,185,945 A 2/1993 Nielsen et al.
5,551,172 A 9/1996 Yu
5,926,978 A * 7/1999 Smith ..... 36/101
5,946,823 A * 9/1999 Yates ..... 36/11.5
6,430,846 B1 8/2002 Lin
6,898,873 B2 * 5/2005 Schenone ..... 36/112
2002/0023372 A1 2/2002 Noda

* cited by examiner

*Primary Examiner*—Jila M Mohandesi
(74) *Attorney, Agent, or Firm*—Parsons & Goltry; Michael W. Goltry; Robert A. Parsons

(57) ABSTRACT

A shoe includes a toe section fabricated of a plurality of ribs which are pivotally movable relative the sole and support a flexible panel. The toe section is movable between an extended position to enclose the toes of the foot of a wearer and wherein the several ribs are circumferentially spaced and a retracted position in which the toes of the foot are exposed and the ribs reside mutually adjacent. Also provided is a heel section including a plurality of ribs supporting a flexible panel and movable between an extended position in which the heel of the foot is at least partially enclosed and a retracted position in which the heel is exposed.

35 Claims, 6 Drawing Sheets

Fig. 13
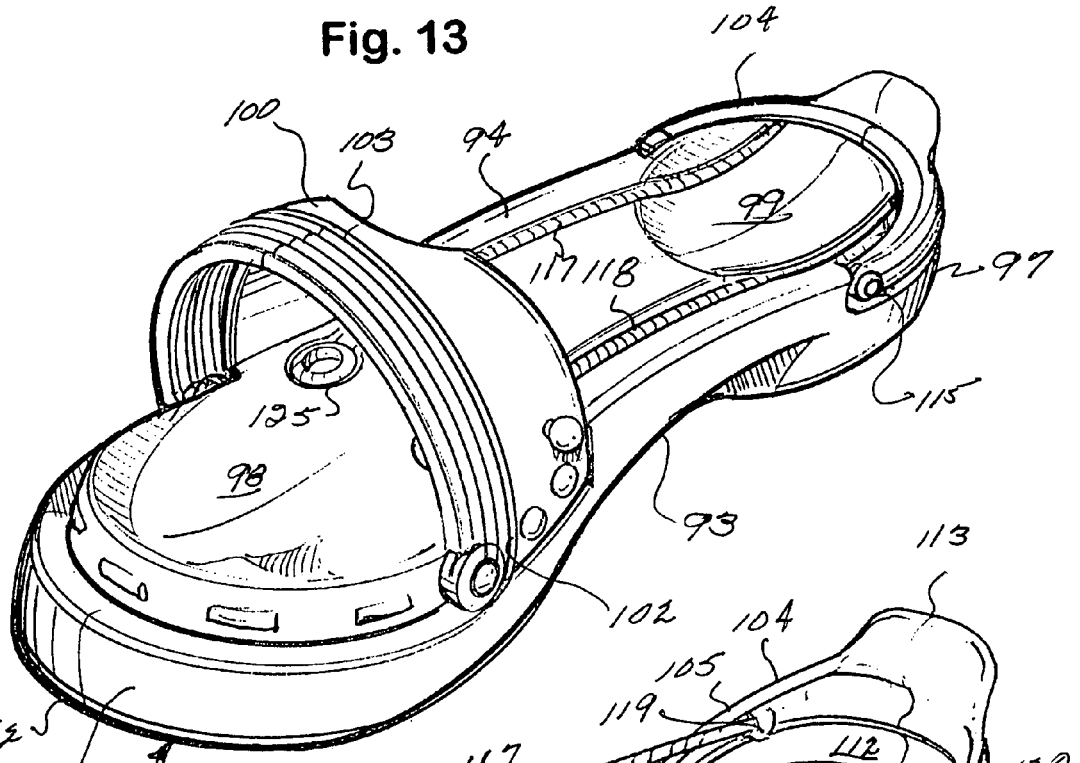
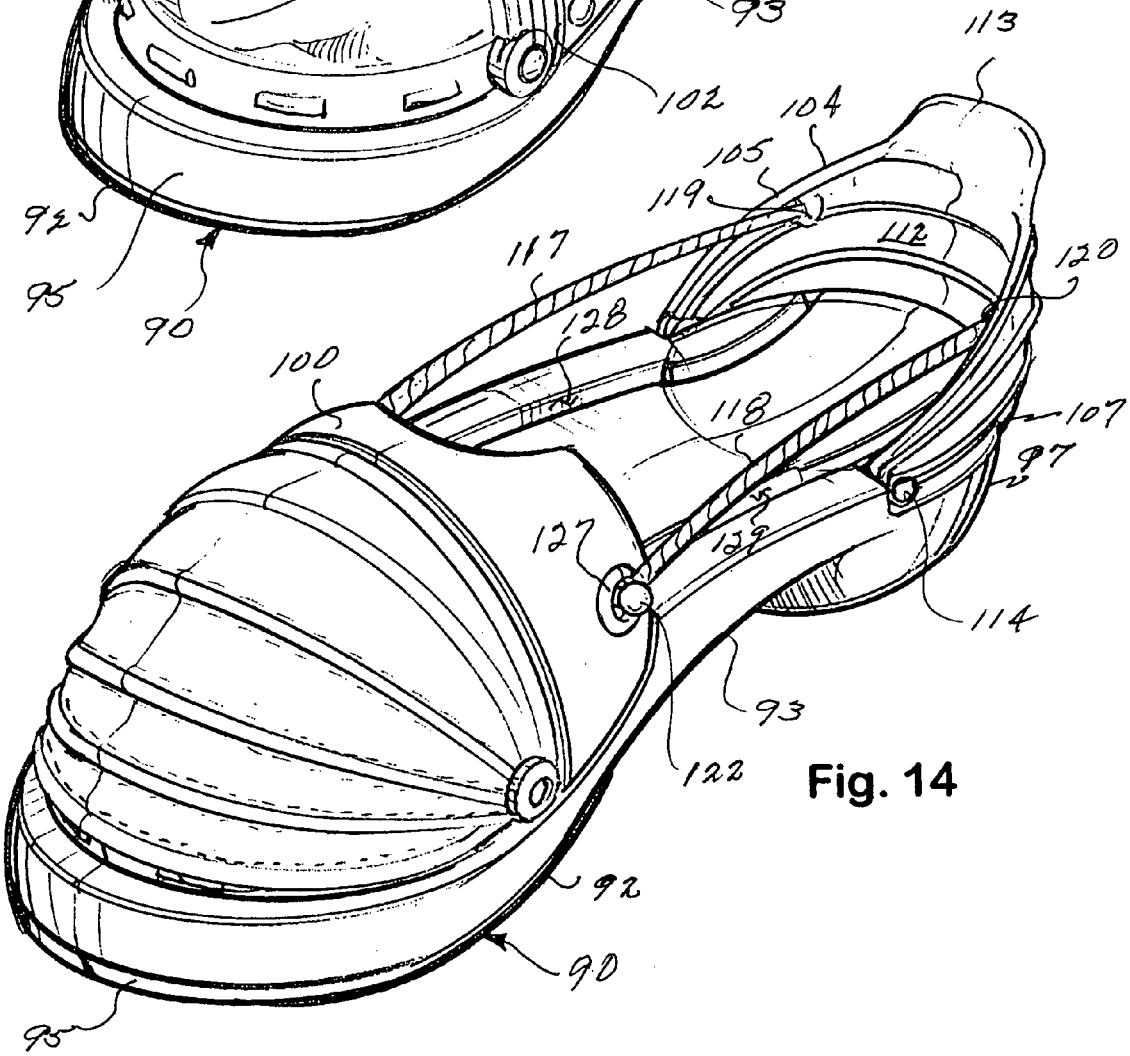
Fig. 14

SHOE

BACKGROUND OF THE INVENTION

1. Field of the Invention

This invention relates to footwear.

More particularly, the present invention relates to shoes.

In a further and more specific aspect, the instant invention concerns a shoe having sections which are selectively movable between a deployed position for covering parts of the foot and a retraced position in which the parts of the foot are exposed.

2. The Prior Art

The prior art is replete with footwear of various types and styles. Of immediate interest are shoes, generally the type commonly referred to as low-quarter, and sandals.

Common to shoes and to sandals is a sole assembly which includes an outer sole and an inner sole. The outer sole, which is receivable upon a walking surface such as pavement, is generally fabricated of a durable material such as rubber or leather. The inner sole, usually fabricated of a resilient material such as foam rubber, receives the foot of a wearer thereon. The toes of the foot bear upon a toe section of the inner sole proximate the forward end of the sole assembly. The heel of the foot bears upon a heel section of the inner sole proximate the rearward end of the sole assembly. It is within the scope of the art that the outer sole and the inner sole may be of unitary construction of a singular material.

The conventional sandal has a vamp traversing the sole assembly and secured thereto at opposite ends. The insole of the foot is received within the vamp. The heel and the toes of the foot are exposed. A shoe also has a vamp for receiving the insole of the foot. Indifference to the sandal, however, the shoe also includes panels which embrace the toes and the heel.

Shoes and sandals are usually worn for different purposes. Sandals are commonly preferred for casual or informal wear. Sandals are also footwear of choice when the ambient temperature, indoors or outdoors, is warm. Shoes are generally preferred for more formal wear. Due to the greater coverage of the foot, shoes are more desired in cooler temperatures.

It is not common practice to wear one type of footwear and carry another in reserve. Changing from one type to another generally requires that the wearer make a return to home for the exchange.

Therein lies a problem. For example, many establishments, especially restaurants, demand that the foot be covered as a requirement for admission. The would-be diner, then, having been on a casual outing and wearing sandals must either forsake the restaurant or make a time wasting trip to another location to change into shoes. A reverse situation, in which the wearer has shoes, is also plausible.

There are other occasions when having either shoes or sandals gives rise to the other. For example, the wearer may have ventured forth in the heat of the day wearing sandals. As evening draws nigh and the temperature falls, shoes would be more desirable. Conversely, the wearer may have ventured out in the cool of the morning wearing shoes. As the sun rises and the temperature increase, sandal would be more desirable.

SUMMARY OF THE INVENTION

The above problems and others are at least partially solved and the above objects and others realized in a convertible shoe including a sole assembly having a forward end and a rearward end, an outer sole receivable upon a walking surface and an inner sole for receiving the foot of a wearer thereon. The assembly further includes a toe section proximate the forward end and a heel section proximate the rearward end.

The foot of the wearer includes a heel borne by the heel section of the sole assembly, a plurality of toes borne by the toe section of the sole assembly and an inner step intermediate the heel and the toes. A vamp carried by the sole assembly receives the instep of the foot.

The convertible shoe includes a convertible section movable between a retracted position wherein the convertible section is compressed to reveal the toes of the foot and a deployed position in which the convertible section extends over the toes of the foot.

In accordance with the principles of the instant invention, the convertible section includes a rearward edge affixed to the forward edge of the vamp and a forward edge in contact with the sole assembly when the section is in the deployed position. Also provided are retention means for detachably securing the forward edge of the convertible section to the sole assembly when the convertible section is in the deployed position.

It is within the principles of the present invention that a recess is formed into the sole assembly for receiving the forward edge of the convertible section when in the deployed position. Retention means are provided to detachably retain the forward edge of the convertible section within the recess. In accordance with one embodiment, the retention means includes an element of an engagement pair carried with the recess and a complemental element of the engagement pair carried by the convertible section. More specifically, the engagement pair includes an element of a hook and loop fastener and a complemental element of the hook and loop fastener. Alternately, the retention means includes a detent residing within the recess for snapedly receiving the forward edge of the convertible section.

The principles of the present invention contemplate that the inner sole terminates at the forward end with an upright surface and the outer sole terminates with a terminal section extending forward of the forward end of the inner sole and having an upper surface. The upright surface of the inner sole and the upper surface of the outer sole cooperate to form a recess for receiving the forward edge of the convertible section when in the deployed position. Retention means within the recess detachably secure the forward edge of the convertible section when in the deployed position.

It is within the purview of this invention that an arcuate rib be integral with the forward edge of the convertible section and be pivotally movable relative the sole assemble. The rib is detachably retained within a recess within the sole assembly when the convertible section is in the deployed position. It is also contemplated that a second rib may be integral with the convertible section intermediate the forward edge and the rearward edge.

In a further embodiment, in accordance with the principles of the present invention, the convertible section includes a plurality of down turned ribs pivotally movable relative the sole assembly. A flexible panel is supported by the several ribs. The several ribs are circumferentially spaced when the convertible section is in the deployed position and are mutually adjacent when the convertible section is in the retracted position.

In an alternate embodiment, consistent with the principles of the invention, the vamp includes a forward edge and the convertible section includes a forward edge affixed to the sole assembly and a rearward edge in contact with the forward edge of the vamp when in the deployed position. Retention means are provided for detachably securing the rearward edge of the convertible section to the forward edge of the vamp.

Yet another embodiment is contemplated within the principles of the instant invention. The immediate embodiment includes a sole assembly as previously described. Further provided is a convertible section having a first end residing in juxtaposition with the sole assembly and a second end residing in a lowered position when the convertible section is in the retracted position and an elevated position when the convertible section is in the deployed position and extends over at least a portion of the heel of the foot. Retention means for releasably retaining the second of the convertible section in the elevated position includes a strut secured to the convertible section and having a free end detachably engagable with the vamp.

A preferred retention means includes a protrusion projecting from the vamp and an eyelet carried at the free end of the strut for receiving the protrusion. A recess formed into the sole assembly proximate the rearward edge thereof receives the first edge of the convertible section. It is within the teaching of this invention that the present convertible section may includes a plurality of down turned ribs as described in connection with the previously described convertible section.

BRIEF DESCRIPTION OF THE DRAWINGS

The foregoing and further and more specific objects and advantages of the instant invention will become readily apparent to those skilled in the art from the following detailed description thereof taken in conjunction with the drawings, in which:

FIG. 13 is a perspective view of another convertible shoe constructed in accordance with the teachings of the present invention, said shoe having a convertible heel section being shown in a retracted position;

FIG. 14 is a perspective corresponding to the view of FIG. 13 and illustrating the heel section in a deployed position;

DETAILED DESCRIPTION OF PREFERRED EMBODIMENTS

Figure 1:
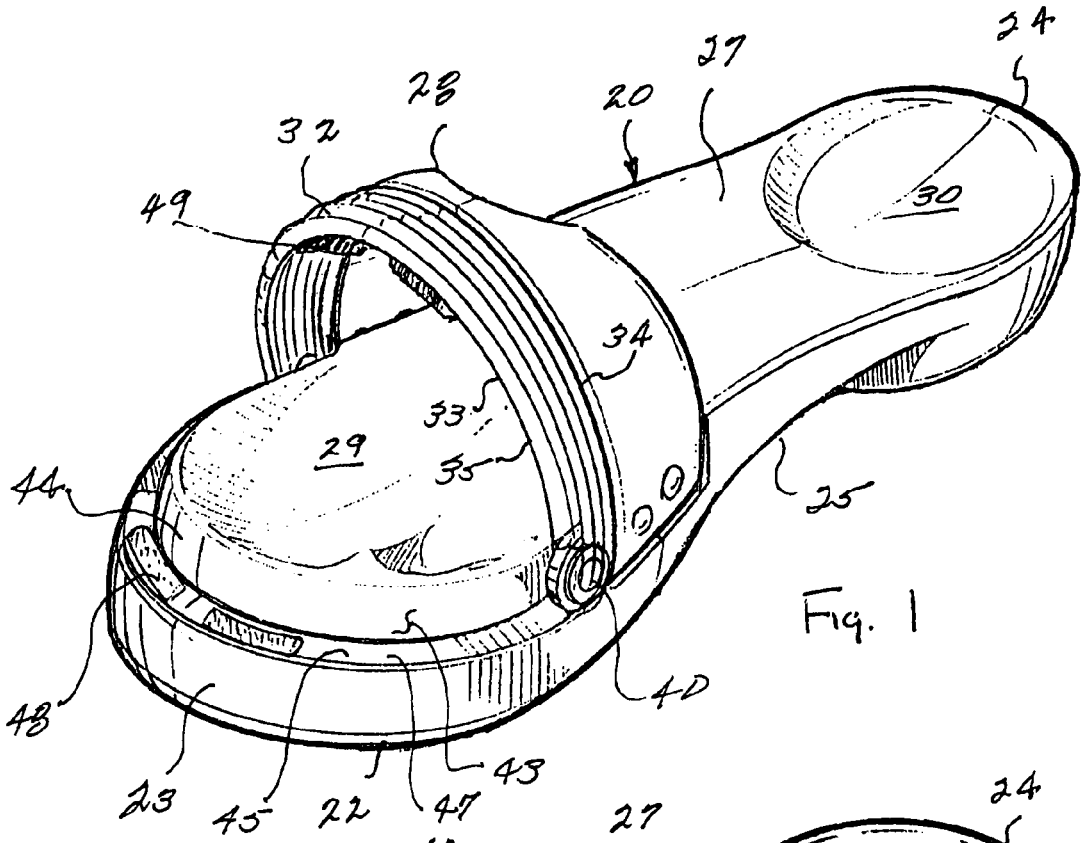
FIG. 1 is a perspective view of a convertible shoe constructed in accordance with the principles of the instant invention, said shoe having a toe section being shown in the retracted position.

Turning now to the drawings, in which like reference characters indicate corresponding elements throughout the several views, attention is first directed to FIG. 1, in which is illustrated a convertible shoe embodying the principles of the instant invention and generally designated by the reference character 20. Convertible shoe 20, in general similarity to conventional footwear, includes sole assembly 22, including forward end 23, rearward end 24, outer sole 25 and inner sole 27. Vamp 28 extends laterally and arcuately across the instep region of sole assembly 22 and is secured at opposite ends thereof to the sole assembly 22.

In accordance with conventional practice, outer sole 25, which is received upon a walking surface such as a floor or concrete, is fabricated of a durable material such as leather or dense rubber. Inner sole 27 is fabricated of a resilient material such as foam rubber. Alternately, outer sole 25 and inner sole 27 may be integral and fabricated of such materials as rubber or leather. The foot of a wearer is received upon inner sole 27. The instep of the foot is received within vamp 28. The toes of the foot are borne by toe section 29 while the heel of the foot is borne by heel section 30. Further and more specific details of the foregoing not specifically illustrated nor described will be readily appreciated by those skilled in the art.

Convertible shoe 20 includes convertible toe section 32 fabricated in accordance with the principles of the instant invention. Convertible toe section 32, as further illustrated in FIG. 2, includes forward edge 33, rearward edge 34 and a plurality of down turned, arcuate ribs. Rib 35 is integral with forward end 33 of convertible section 32. Rib 37 is integral with the rearward edge of convertible section 32. A plurality of ribs 38 resides intermediate ribs 35 and 37. Panel 39, such as may be fabricated of selected flexible material, overlays the several ribs. Further description of the relationship between the several ribs and the panel will be made presently.

Figure 2:
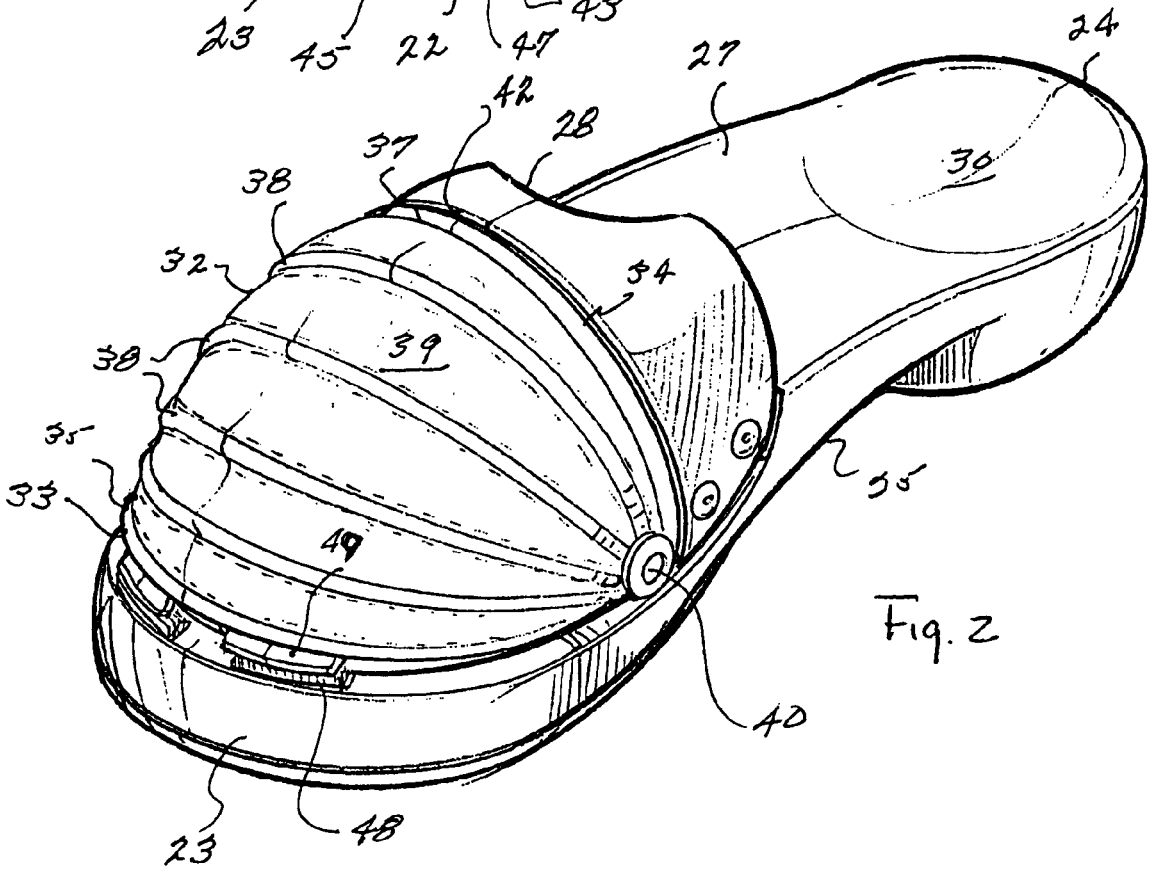
FIG. 2 is a perspective view corresponding to the view of FIG. 1, said toe section being shown in the deployed position.
Figure 3:
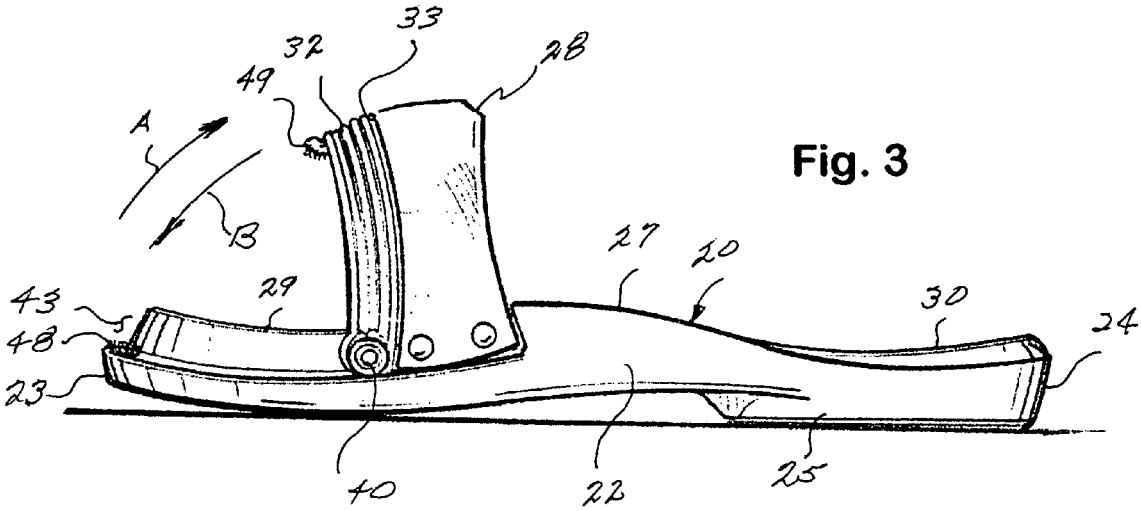
FIG. 3 is a side elevation view of the convertible shoe seen in FIG. 1.
Figure 4:
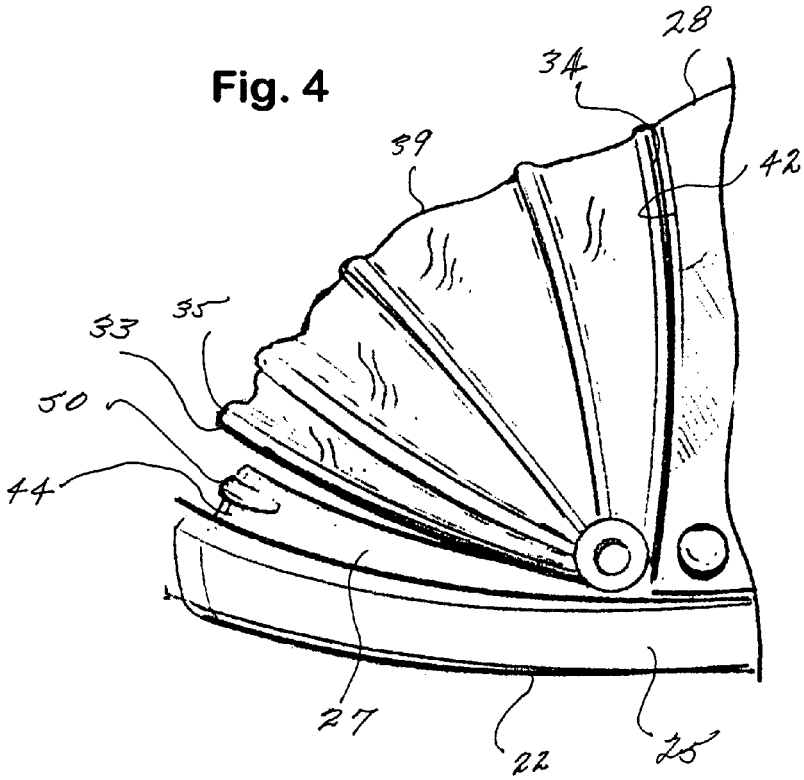
FIG. 4 is an enlarged, fragmentary view of the toe section seen in FIG. 2.

Convertible section 32 is movable in the direction indicated by the arcuate arrowed line A in FIG. 3 to a retracted position as illustrated in FIG. 1, and in the direction of the arcuate arrowed line B to a deployed position as illustrated in FIG. 2. During movement from one position to the other, the several ribs, 35 and 38 pivot about pin 40 for relative circumferential movement. In the deployed position, the several ribs are circumferentially spaced. In the retracted position the several ribs are mutually adjacent. It is noted that in the retracted position, the toe section 29 of insole 27 is exposed as are the toes of the foot. Conversely, in the deployed position, convertible section 32 extends over toe section 29 and, hence, the toes of the wearer.

Rearward edge 34 of convertible section 32 is permanently affixed to forward edge 42 of vamp 28. In the deployed position, forward edge 33 of Convertible section 32 is received within recess 43 formed into sole assembly 22. In accordance with a preferred embodiment of the invention recess 43 is defined by upright surface 44 at the forward end of inner sole 27 and the upper surface 45 of terminal section 47 of outer sole 25 extending forward of upright surface 44.

It is within the purview of the instant invention to provide retention means for detachably securing the forward edge 33 of convertible section 32 within recess 43. In accordance with a preferred embodiment, the retention means includes an element 48 of a hook and loop fastener within recess 43. A complemental element 49 of the hook and loop fastener is carried by the forward edge 33 of convertible section 32.

Other means are also envisioned for detachably securing the forward edge 33 of convertible section 32 to sole assembly 22. With reference to FIG. 3, there is illustrated a detent 50 projecting from the upright surface 44 defining the forward edge of inner sole 27. Detent 50 snapedly receives rib 35 carried at the forward edge 33 of convertible toe section 32.

Figure 5:
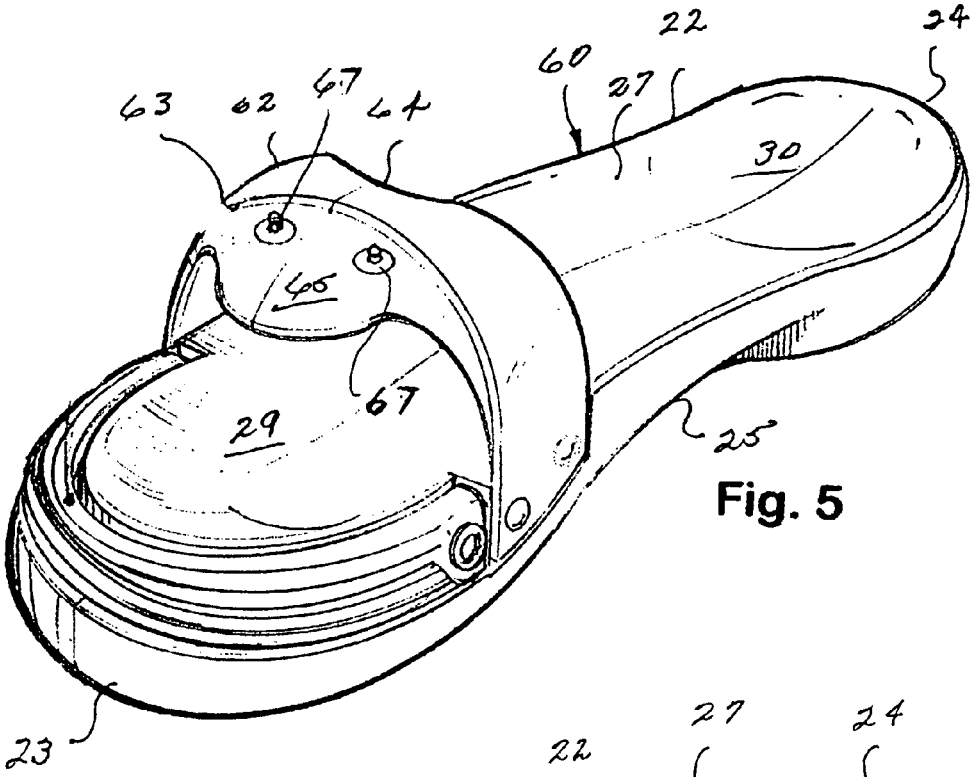
FIG. 5 is a perspective of an alternate convertible shoe embodying the principles of the instant invention, said shoe having a convertible toe section being shown in the retracted position.

Reference is now made to FIG. 5, wherein there is illustrated an alternate convertible shoe embodying the principles of the instant invention and generally designated by the reference 60. In common with the previously described embodiment 20, convertible shoe 60 includes sole assembly 22 having forward end 23, rearward end 24, outer sole 25 and inner sole 27. Toe section 29 and heel section 30 are integral with inner sole 27.

Vamp 62 having forward edge 63 and rearward edge 64 arcuately spans sole assembly 22 intermediate toe section 29 and heel section 30. The ends of vamp 62 are secured to sole assembly 22 as by pins, glue or by other conventional means known to those skilled in the art. Tab 65 projects forwardly from the forward edge 63 of vamp 62. Two elements 66 of a snap engagement pair are secured to tab 65. Vamp 62, in accordance with common practice, is fabricated of a durable material such as leather. Preferably, tab 65 is integral with vamp 62.

Figure 6:
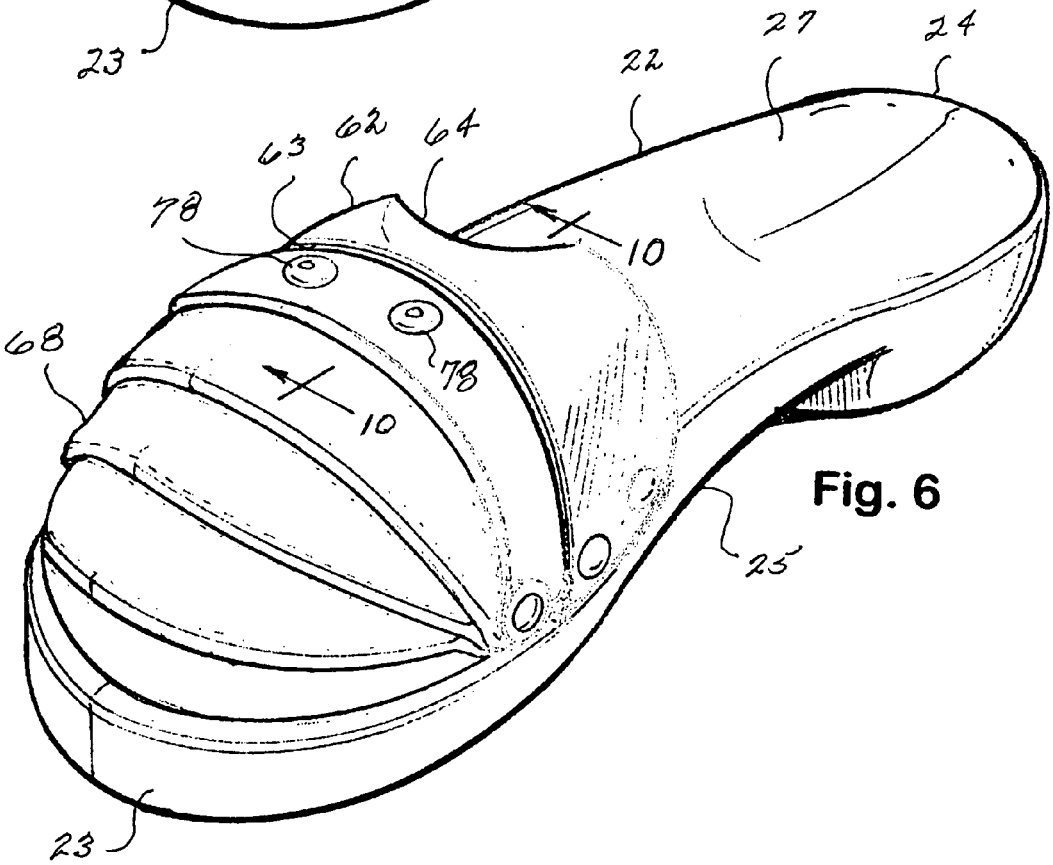
FIG. 6 is a perspective view corresponding to the view of FIG. 5, said convertible toe section being shown in the deployed position.
Figures 7, 8, 9, 10, 11, 12:
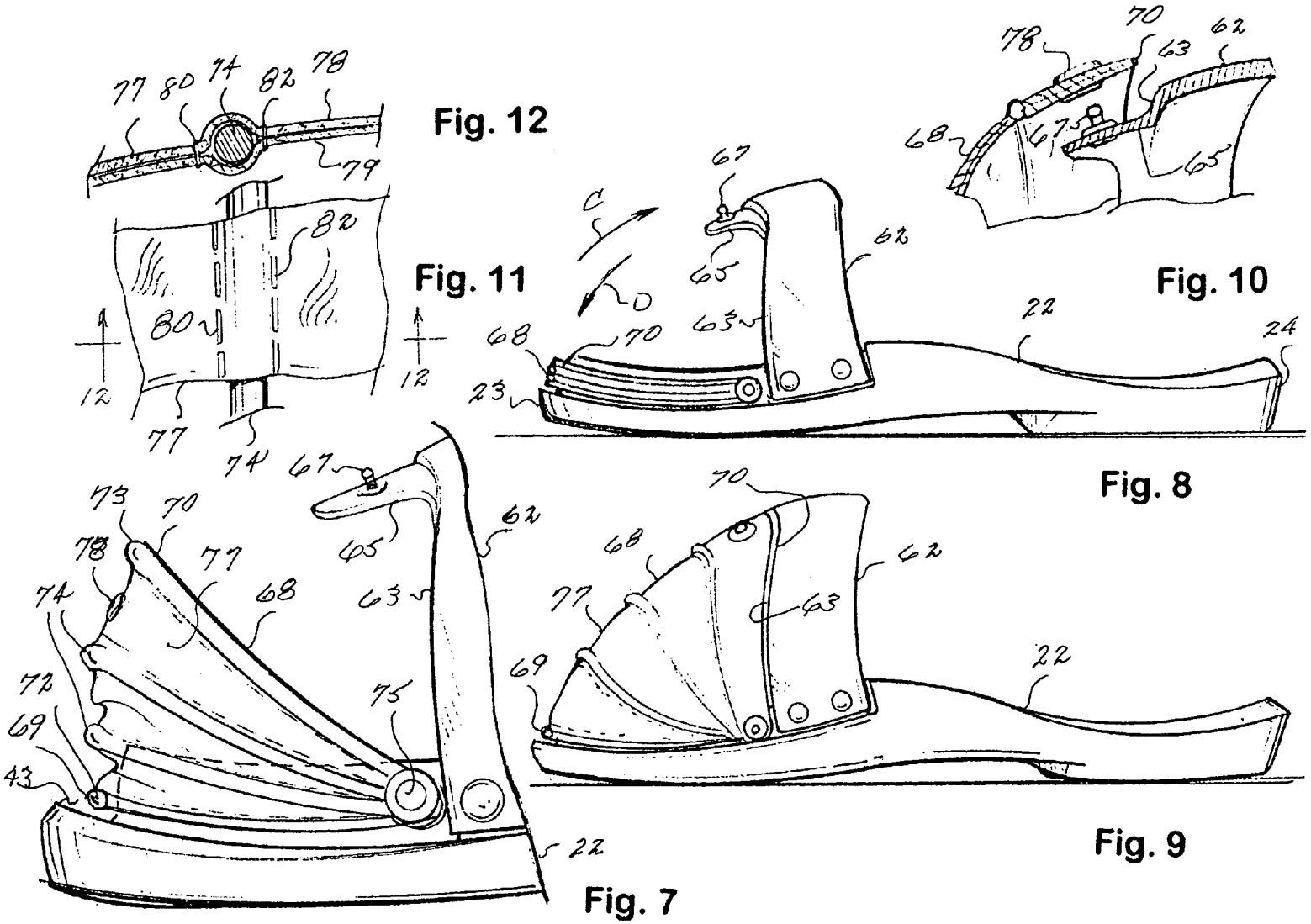
FIG. 7 is an enlarged fragmentary, elevational view of the forward section of the shoe seen in FIG. 6.
FIG. 8 is a side elevational view of the convertible shoe as seen in FIG. 5.
FIG. 9 is a side elevation view of the convertible shoe as seen in FIG. 6.
FIG. 10 is an enlarged, fragmentary sectional view taken along the line 10-10 in FIG. 6.
FIG. 11 is an enlarged, fragmentary top plan view of the toe section of the shoe illustrated in FIG. 9.
FIG. 12 is a vertical sectional view taken along the line 12-12 in FIG. 11.

Attention is now directed to FIGS. 6 and 7 which illustrate a convertible toe section 68 comprising a part of the embodiment of the convertible shoe generally designated 60. Convertible toe section 68 includes forward edge 69 and a rearward edge 70. In similarity to previously described convertible toe section 32, the immediate convertible toe section 69 includes forward rib 72 integral with forward edge 69 of convertible toe section 68, a rearward rib 73 integral with rearward edge 70 of convertible toe section 68 and a plurality of intermediate ribs 74.

The several ribs are arcuate and down turned. Forward rib 72 is permanently affixed within recess 43, as by glue or other known means. Intermediate ribs 74 and rearward rib 73 are pivotally movable about pin 75.

The several ribs 72, 73 and 74 support panel 77 which may be fabricated of flexible leather, cloth or any other suitable material. A complemental elemental 78 of the previously noted snap engagement pair is carried by panel 77 intermediate rearward rib 73 and the immediate adjacent rib 74.

As noted in FIG. 8, rearward edge 70 of convertible toe section 60 is moved in the direction of arcuate arrowed line C to expand convertible toe section into a deployed position as illustrated in FIG. 9. Conversely, rearward edge 70 of convertible toe section 60 is moved in the direction of arcuate arrowed line D to a retracted position as illustrated in FIG. 8, wherein the several ribs are mutually adjacent.

Referring now to FIG. 10, convertible toe section 68 is illustrated in the deployed position with rearward edge 70 of convertible toe section 68 in close proximity to forward edge 63 of vamp 62. Complemental element 78 of the snap engagement pair is aligned with element 67 of the snap engagement pair. Element 67 and complemental element 78 are readily snapedly engaged to retain convertible toe section in the deployed position. In a reverse procedure, element 67 and complemental element 78 are disengaged whereby convertible toe section 68 can be moved to the retracted position.

With reference to FIG. 11, there is illustrated a rib 74 and panel 77. Panel 77, as seen in greater detail in FIG. 12, includes outer layer 78 and inner layer 79. Rib 74 is positionally captivated between the layers 78 and 79 by lines of stitching 80 and 82 sewn along opposite sides of rib 74. It is within the principles of the instant invention that rib 74 may be positionally captivated by other means such as glue. It is also with the purview of the invention that panel 77 be fabricated of a single layer to which rib 77 is bonded or otherwise affixed.

Attention is now directed to FIG. 13, in which is illustrated another alternate embodiment of a convertible shoe incorporating the principles of the instant invention and generally designated by the reference character 90. Convertible shoe 90, in general similarity to the previously described embodiments includes sole assembly 92 having outer sole 93, inner sole 94, forward end 95 and rearward end 97. The foot of a wearer is received upon inner sole 94 with the toes of the foot bearing upon toe section 98 and the heel of the foot bearing upon heel section 99. Convertible shoe 90 further includes vamp 100 having forward edge 102 and rearward edge 103. Vamp 100 extends arcuately over sole assembly 92 and is secured at opposite ends thereof to sole assembly for receiving the instep of the foot.

Figure 15:
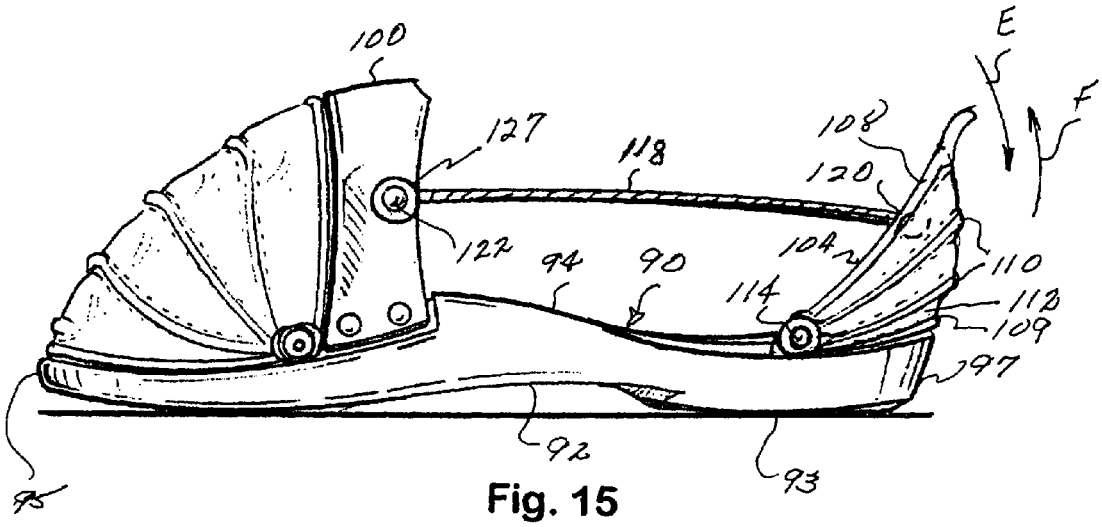
FIG. 15 is a side elevational view taken from the illustration of FIG. 14.

With additional reference to FIGS. 14 and 15, it is seen that the immediate embodiment of the convertible shoe 90 includes a convertible heel section 104 having upper edge 105 and lower edge 107. In general similarity to the previously described convertible sections, convertible heel section includes a plurality of arcuate ribs. Upper rib 108 is affixed to upper edge 105 and lower rib 109 is affixed to lower edge 107. Intermediate ribs 110 reside intermediate upper rib 108 and lower rib 109. The several ribs support panel 112. Pull tab 113 extends from upper edge 105.

As seen in FIG. 15, convertible heel section 104 is movable in the direction of arcuate arrowed line E to a retracted position as specifically illustrated in FIG. 13. Alternately, convertible heel section is movable in the direction designated by arcuate arrowed line F to a deployed position as specifically illustrated in FIG. 14. During movement, the several ribs pivot about pin 114 to which the ends of the ribs are attached. Although not specifically illustrated, it is to be understood that the other ends of the several ribs are pivotally attached to another pin opposing pin 114 on the opposite side of sole assembly 92. In the retracted position, convertible heel section 104 is received within recess 115 formed into the rearward end of sole assembly 92.

Next provided by the immediate embodiment of the invention are a pair of struts 117 and 118. Strut 117 terminates with an end 119 which is affixed to convertible heel section 104 proximate the upper edge 108. Similarly, strut 118 terminates with an end 120 which is affixed to convertible heel section 104 proximate the upper edge 108 at a location spaced from end 119 of strut 117. The struts may be fabricated of leather or any flexible cordage material.

Figure 16:
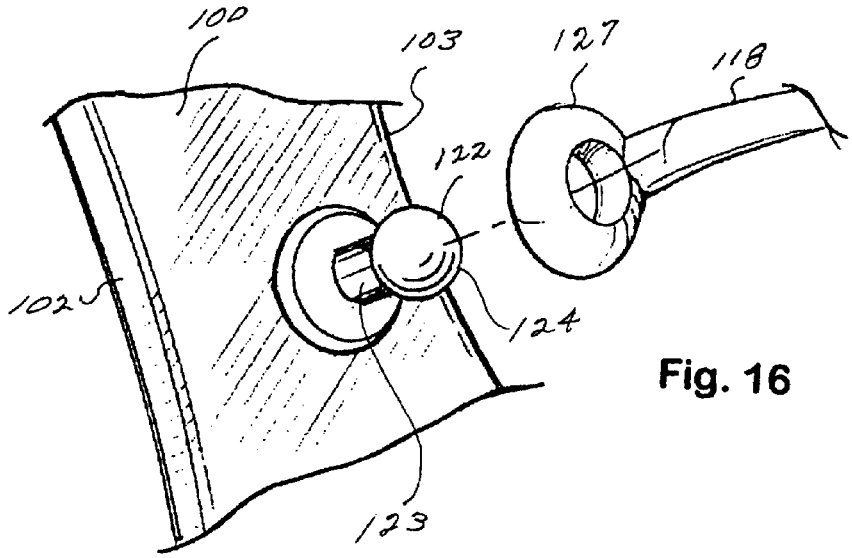
FIG. 16 is an enlarged, fragmentary perspective view of a portion of the shoe seen in FIG. 15.

A protrusion 122, as illustrated in FIG. 16, having stem 123 and ball end 124 projects from vamp 100. Although not specifically illustrated it is understood that a complementary protrusion projects from the other side of vamp 100. Strut 117 terminates at the free end with eyelet 125. Similarly, strut 118 terminates at the free end with eyelet 127. Eyelet 127 is snapedly engagable with protrusion 122 to retain convertible heel section 104 in the deployed position. Concurrently, eyelet 124 is engaged with the respective protrusion. When the eyelets 125 and 127 are disengaged from the respective protrusions and convertible heel section 104 is in the retracted position, strut resides within recess 128 and strut 118 resides within recess 129.

The present invention is described above with reference to a preferred embodiment. However, those skilled in the art will recognize that changes and modifications may be made in the described embodiment without departing from the nature and scope of the present invention.

Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A convertible shoe comprising:

a sole assembly having a forward end and a rearward end and including an outer sole receivable upon a walking surface, an inner sole for receiving a foot of a wearer thereon, a toe section proximate the forward end, and a heel section proximate the rearward end;

said foot having a heel borne by the heel section of said sole assembly, a plurality of toes borne by the toe section of said sole assembly and an instep intermediate said heel and said toes;

a vamp carried by said sole assembly for receiving the instep of said foot there under;

a convertible section having a forward edge and movable between a retracted position wherein said convertible section is compressed to reveal the toes of said foot and a deployed position in which said convertible section extends over the toes of said foot;

a recess formed into said sole assembly for receiving the forward edge of said convertible section when in the deployed position; and retention means for detachably retaining the forward edge of said convertible section within said recess including an element of an engagement pair carried within said recess, and a complemental element of said engagement pair carried by said convertible section.

2. The convertible shoe of claim 1, wherein:

said vamp includes a forward edge; and said convertible section further includes a rearward edge affixed to the forward edge of said vamp and said forward edge of the convertible section being in contact with said sole assembly when in the deployed position.

3. The convertible shoe of claim 1, wherein the element of the engagement pair includes one of a hook and loop fastener and the complemental element of the engagement pair includes the other of the hook and loop fastener.

4. The convertible shoe of claim 1, wherein the element of the engagement pair includes a detent carried within said recess for snapedly receiving the forward edge of said convertible section, the forward edge of the convertible section snappedly received by the detent comprising the complemental engagement element of the engagement pair.

5. The convertible shoe of claim 1, further including an arcuate rib integral with the forward edge of said convertible section and pivotally movable relative said sole assembly.

6. The convertible shoe of claim 5, further including a recess formed in said sole assembly for receiving said rib when said convertible section is in the deployed position.

7. The convertible shoe of claim 6, further including retention means for detachably retaining said rib in said recess when said convertible section is in the deployed position.

8. The convertible shoe of claim 7, wherein said retention means includes a detent for snapedly engaging said rib.

9. The convertible shoe of claim 5, further including a second rib carried by said convertible section intermediate the forward edge and the rearward edge of the convertible section.

10. The convertible shoe of claim 1, wherein said convertible section includes:

a plurality of down turned arcuate ribs pivotally movable relative to said sole assembly; and a flexible panel supported by said ribs.

11. The convertible shoe of claim 10, wherein:

said ribs are circumferentially spaced when said convertible section is in the deployed position; and said ribs are mutually adjacent when said convertible section is in the retracted position.

12. The convertible shoe of claim 1, wherein:

said vamp includes a forward edge; and said convertible section includes a forward edge and a rearward edge, said forward edge being affixed to said sole assembly and said rearward edge being in contact with the forward edge of said vamp when in the deployed position.

13. The convertible shoe of claim 12 further including retention means for detachably securing the rearward edge of said convertible section to the forward edge of said vamp when said convertible section is in the deployed position.

14. The convertible shoe of claim 13, wherein said retention means includes:

an element of an engagement pair carried proximate the forward edge of said vamp; and a complemental element of said engagement pair carried proximate the rearward edge of said convertible section.

15. The convertible shoe of claim 14, wherein said engagement pair includes an element of a hook and loop fastener and a complemental element of said hook and loop fastener.

16. The convertible shoe of claim 12, wherein said retention means includes:

a element of a snap engagement pair carried by said vamp; and a complemental element of said snap engagement pair carried by said convertible section.

17. A convertible shoe comprising:

a sole assembly having a forward end and a rearward end and including an outer sole receivable upon a walking surface, an inner sole for receiving a foot of a wearer thereon, a toe section proximate the forward end, and a heel section proximate the rearward end;

said foot having a heel borne by the heel section of said sole assembly, a plurality of toes borne by the toe section of said sole assembly and an instep intermediate said heel and said toes;

a convertible section including first and second ends and movable between a retracted position wherein said convertible section is compressed to reveal the heel of said foot and a deployed position in which said convertible section extends over at least a portion of the heel of said foot;

said first end of said convertible section residing in juxtaposition with said sole assembly, and said second end of said convertible section residing in a lowered position when said convertible section is in the retracted position and in an elevated position when said convertible section is in the deployed position;

retention means for releasably retaining the second end of said convertible section in the elevated position; and a vamp carried by said sole assembly intermediate said toe section and said heel section for receiving an instep of said foot;

wherein said retention means includes a strut secured to said convertible section proximate the second end thereof and having a free end detachably engagable with said vamp.

18. The convertible shoe of claim 17, wherein said retention means further includes:

an element of an engagement pair carried by said vamp; and a complemental element of said engagement pair carried at the free end of said strut.

19. The convertible shoe of claim 18, wherein said complemental element of said engagement pair is snapedly engagable with the element of said engagement pair.

20. The convertible shoe of claim 17, further including:

a protrusion projecting from said vamp; and an eyelet carried at the free end of said strut for receiving said protrusion.

21. The convertible shoe of claim 17, further including a recess formed into said sole assembly for receiving the first end of said convertible section.

22. The convertible shoe of claim 17, wherein:

said inner sole terminates at the rearward end with an upright surface;

said outer sole terminates at the rearward end with a terminal section extending rearward of the upright surface of said inner sole and having an upper surface projecting rearwardly from the upright surface of said inner sole; and the rearward surface of said inner sole and the upper surface of said outer sole cooperating to form a recess for receiving the first end of said convertible section.

23. The convertible shoe of claim 17, further including a down turned arcuate rib integral with the second end of said convertible section and pivotally moveable relative said sole assembly.

24. The convertible shoe of claim 17, wherein said convertible section includes:

a plurality of down turned arcuate ribs pivotally movable relative said sole assembly; and a flexible panel supported by said ribs.

25. The convertible shoe of claim 24, wherein:

said ribs are circumferentially spaced when said convertible section is in the deployed position; and wherein said ribs are mutually adjacent when said convertible section is in the retracted position.

26. A convertible shoe comprising:

a sole assembly having a forward end and a rearward end and including an outer sole receivable upon a walking surface, an inner sole for receiving a foot of a wearer thereon, a toe section proximate the forward end, and a heel section proximate the rearward end;

said foot having a heel borne by the heel section of said sole assembly, a plurality of toes borne by the toe section of said sole assembly and an instep intermediate said heel and said toes;

a vamp carried by said sole assembly for receiving the instep of said foot there under;

a convertible section having a forward edge and movable between a retracted position wherein said convertible section is compressed to reveal the toes of said foot and a deployed position in which said convertible section extends over the toes of said foot;

said inner sole terminates with an upright forward surface; and said outer sole terminates with a terminal section extending forward of the forward surface of said inner sole and having an upper surface projecting forwardly from the forward surface of said inner sole;

the forward surface of said inner sole and the upper surface of said outer sole cooperating to form a recess to receive the forward edge of said convertible section when in the deployed position.

27. The convertible shoe of claim 26, further including retention means for detachably securing the forward edge of said convertible section within said recess when said convertible section is in the deployed position.

28. The convertible shoe of claim 27, wherein said retention means includes:

an element of an engagement pair carried within said recess; and a complemental element of said engagement pair carried by the forward edge of said convertible section.

29. The convertible shoe of claim 28, wherein said engagement pair includes an element of a hook and loop fastener and a complemental element of said hook and loop fastener.

30. The convertible shoe of claim 28, wherein said retention means includes a detent carried within said recess for snapedly engaging the forward end of said convertible section.

31. A convertible shoe comprising:

a sole assembly having a forward end and a rearward end and including an outer sole receivable upon a walking surface, an inner sole for receiving a foot of a wearer thereon, a toe section proximate the forward end, and a heel section proximate the rearward end;

said foot having a heel borne by the heel section of said sole assembly, a plurality of toes borne by the toe section of said sole assembly and an instep intermediate said heel and said toes;

a convertible section having a first end and movable between a retracted position wherein said convertible section is compressed to reveal the heel of said foot and a deployed position in which said convertible section extends over at least a portion of the heel of said foot;

said inner sole terminates at the rearward end with an upright surface;

said outer sole terminates at the rearward end with a terminal section extending rearward of the upright surface of said inner sole and having an upper surface projecting rearwardly from the upright surface of said inner sole; and the rearward surface of said inner sole and the upper surface of said outer sole cooperating to form a recess for receiving the first end of said convertible section.

32. The convertible shoe of claim 31, wherein said convertible section includes:

the first end residing in juxtaposition with said sole assembly; and a second end residing in a lowered position when said convertible section is in the retracted position and in an elevated position when said convertible section is in the deployed position.

33. The convertible shoe of claim 32, further including retention means for releasably retaining the second end of said convertible section in the elevated position.

34. The convertible shoe of claim 33, further including:

a vamp carried by said sole assembly intermediate said toe section and said heel section for receiving an instep of said foot; and wherein said retention means includes a strut secured to said convertible section proximate the second end thereof and having a free detachable engagable with said vamp.

35. The convertible shoe of claim 34, wherein said retention means further includes:

an element of an engagement pair carried by said vamp; and a complemental element of said engagement pair carried at the free end of said strut.

* * * * *